United States Patent [19]

Finn

[11] Patent Number: 4,590,698

[45] Date of Patent: May 27, 1986

[54] BARREL BYPASS SYSTEM—FULL LENGTH GROOVE

[76] Inventor: Charles A. Finn, 3204 Production Ave., Oceanside, Calif. 92054

[21] Appl. No.: 475,533

[22] Filed: Mar. 15, 1983

Related U.S. Application Data

[63] Continuation-in-part of Ser. No. 442,612, Nov. 18, 1982.

[51] Int. Cl.[4] ..... F41C 21/00

[52] U.S. Cl. ..... 42/78; 42/76 R

[58] Field of Search ..... 89/14 R; 42/78, 76 R

[56] References Cited

U.S. PATENT DOCUMENTS 1,777,771 10/1930 Scherf ..... 42/78

2,967,369 1/1961 Musser ..... 42/78

3,611,867 11/1969 Silsby ..... 89/14 R

FOREIGN PATENT DOCUMENTS 2064075 6/1981 United Kingdom ..... 89/14 R

*Primary Examiner*—Charles T. Jordan

*Assistant Examiner*—Ted L. Parr

*Attorney, Agent, or Firm*—John E. Wagner

[57] ABSTRACT

The invention relates to an improved barrel for a firearm or cannon wherein the muzzle velocity of the projectile fired is controlled by systematically bypassing around the projectile during its travel through the barrel of the weapon a portion of gases generated upon firing of the weapon.

5 Claims, 13 Drawing Figures

FIG. 1
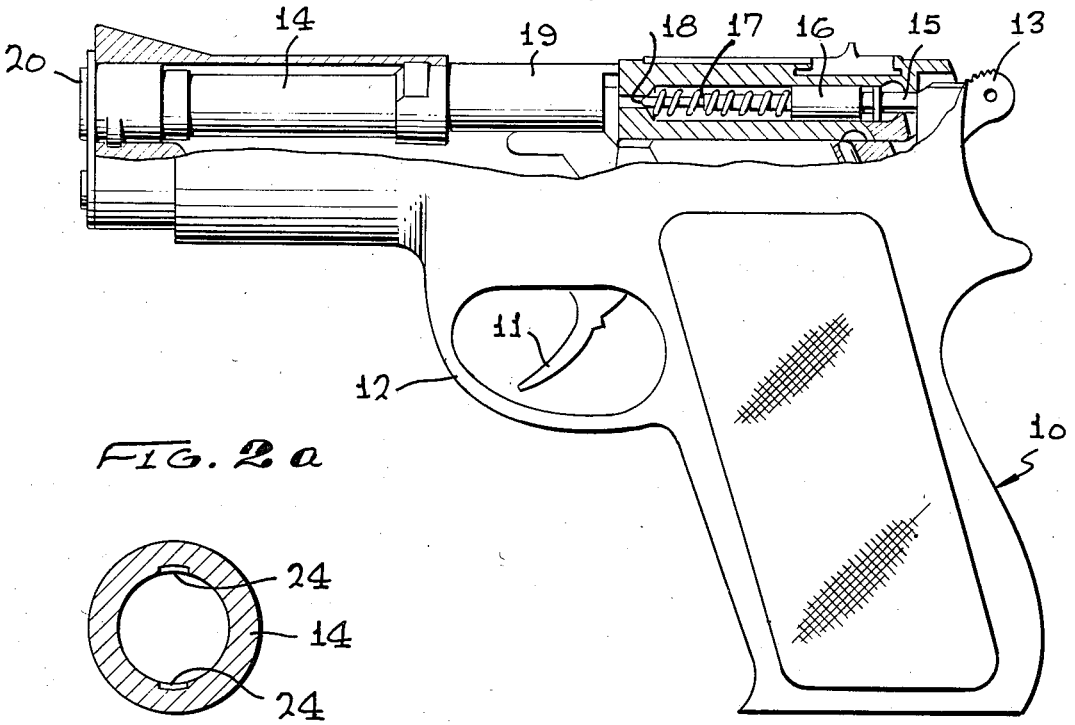
FIG. 2a
FIG. 2
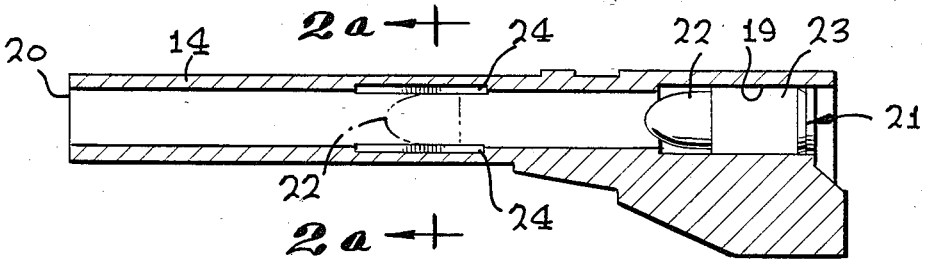
FIG. 3
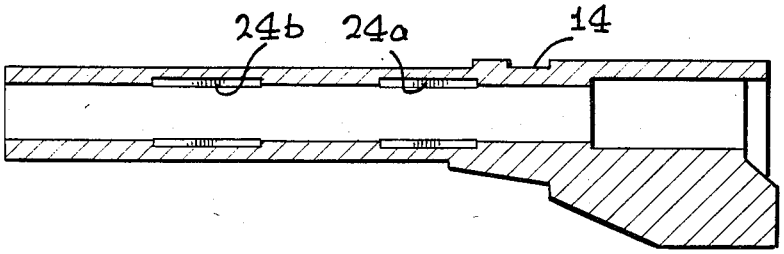

FIG. 4
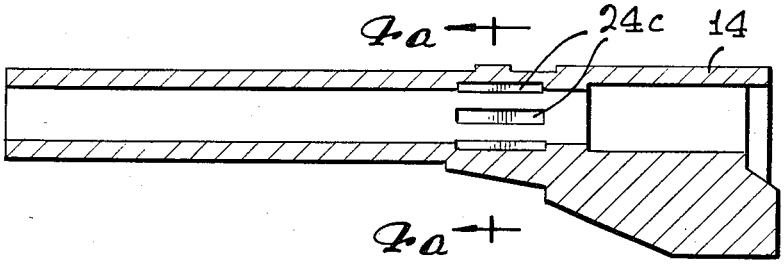
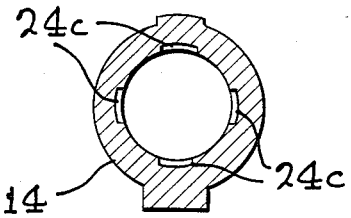
FIG. 4a
FIG. 5
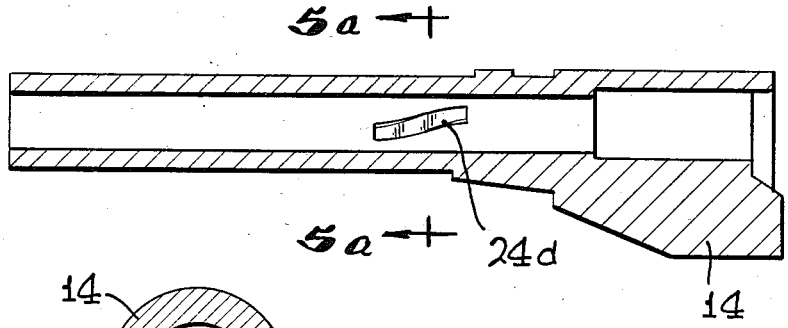
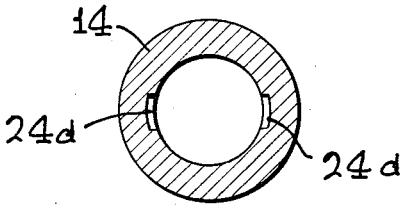
FIG. 5a
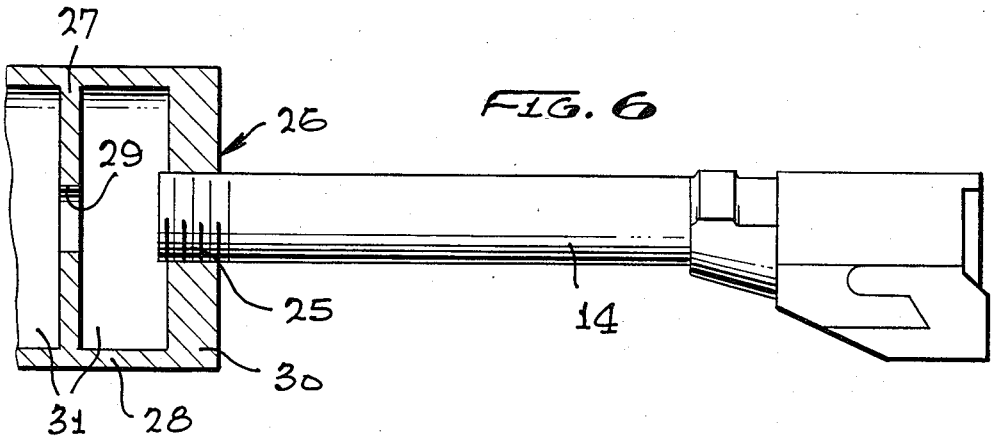
FIG. 6

FIG. 7
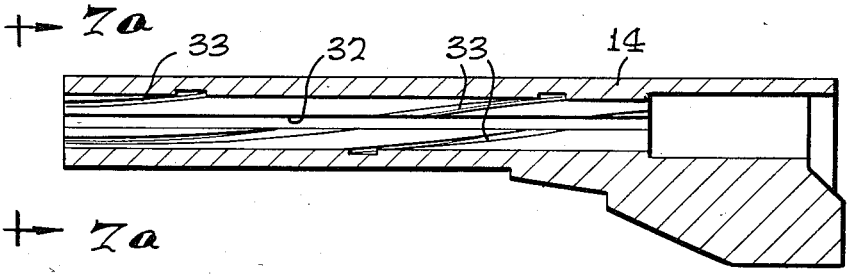
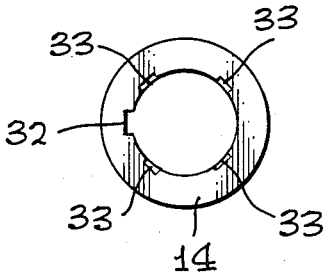
FIG. 7a
FIG. 8
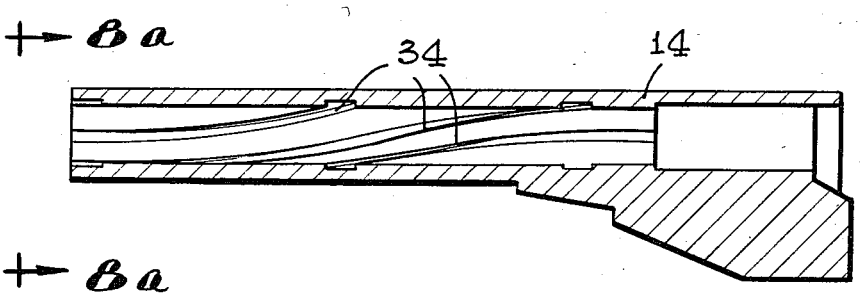
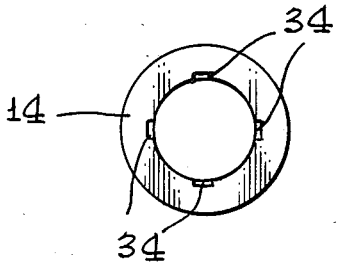
FIG. 8a

BARREL BYPASS SYSTEM—FULL LENGTH GROOVE

This application is a continuation-in-part of application Ser. No. 442,612 filed Nov. 18, 1982, pending, entitled BARREL BYPASS SYSTEM.

FIELD OF INVENTION

The present invention relates to firearms and particularly to an improved barrel for a firearm which controls the muzzle velocity of projectiles discharged by the firearm.

BACKGROUND OF THE INVENTION

It is desired to control muzzle velocity of projectiles discharged from a firearm for various purposes. Two examples of the desire to control muzzle velocity would be to control the penetration of the projectile into a target, and, secondly, to control the environmental impact of the discharge of the weapon, particularly in abatement of noise. The prior art solution in controlling the muzzle velocity of the projectile discharged from the firearm was to adjust the amount of powder contained in the cartridge which was detonated in the firearm, and thus control the amount of force developed to propel the projectile from the barrel of the firearm. This meant that the operator of the firearm had to select a cartridge with a particular amount of powder therein, depending upon the muzzle velocity the operator desired upon discharge of the projectile from the firearm. It has long been desired to have a means of control of the muzzle velocity of the projectile discharged from a firearm wherein a cartridge with a standard amount of powder could be used and the control of the muzzle velocity would reside in something other than the amount of powder in the cartridge. The present invention achieves this effect by providing for a modification of the barrel of the firearm in such a manner so as to produce a unique control of the muzzle velocity of a projectile.

SUMMARY OF THE INVENTION

The present invention provides the method of reducing the muzzle velocity of a projectile discharged from a firearm having a barrel with a firing chamber at one end and a muzzle at the other end, wherein: a cartridge having a casing with a load therein and a projectile crimped at the forward end of the casing is placed in the firing chamber; the load is detonated and generates gas under high pressure which drives the projectile from the firing chamber, into and along the barrel toward the muzzle; and the improvement comprising: by-passing a portion of the high pressure gas around the projectile between the time the projectile leaves the firing chamber and before the projectile reaches the muzzle to thereby reduce the gas pressure driving the projectile through the barrel.

IN THE ACCOMPANYING DRAWINGS

FIG. 1 discloses a firearm partially in section, the firearm is exemplary of a Smith & Wesson Model 39 9 mm automatic hand gun;

FIG. 2 is a vertical longitudinal cross-section of the barrel of the firearm of FIG. 1;

FIG. 2*a* is a vertical transverse cross-section of the barrel of FIG. 2 taken along line 2*a*—2*a* of FIG. 2;

FIG. 3 is a vertical longitudinal cross-section of the barrel of the firearm of FIG. 1 disclosing another embodiment of the invention;

FIG. 4 is a vertical longitudinal cross-section of the barrel of the firearm of FIG. 1, disclosing a further embodiment of the invention;

FIG. 4*a* is a vertical transverse cross-section of the barrel of FIG. 4 taken along line 4*a*—4*a* of FIG. 4;

FIG. 5 is a vertical longitudinal cross-section of the barrel of the firearm of FIG. 1, disclosing a further embodiment of the invention;

FIG. 5*a* is a vertical longitudinal cross-section of the barrel of FIG. 5 taken along 5*a*—5*a* of FIG. 5;

FIG. 6 is a further modification of the barrel of the firearm of FIG. 1 which can incorporate the various embodiments of FIGS. 2 to 5;

FIG. 7 is a vertical cross-sectional view of a still further embodiment of the invention;

FIG. 7*a* is an end view of the barrel of FIG. 7 taken along line 7*a*—7*a* of FIG. 7;

FIG. 8 is a vertical cross-sectional view of a yet still further embodiment of the invention; and FIG. 8*a* is an end view of the barrel of FIG. 8 taken along 8*a*—8*a* of FIG. 8.

DESCRIPTION OF THE INVENTION

In FIG. 1 there is shown generally a firearm comprising the hand held automatic weapon 10 including a hand grip, a trigger 11, a trigger guard 12, a hammer 13, and a barrel 14. As is well known to persons skilled in the art, when the trigger is depressed, the hammer pivots rearwardly. Then, under the action of a spring (not shown) and a sear mechanism (not shown) the hammer 13 is caused to strike one end 15 of a firing pin 16. The firing pin 16 moving against the action of spring 17 causes the other end of the firing pin 18 to strike against the rear end of a cartridge (not shown) in the firing chamber 19 of the barrel 14. The striking of the firing pin 16 against the cartridge causes detonation of the powder within the cartridge, creating an explosive force of gas which separates the projectile from the casing of the cartridge. The explosion produces gas at high pressure which acts to move the projectile forward through the barrel. The firing chamber and casing contained therein prevent loss of gas pressure to the rear and therefore all force produced by the gas pressure is primarily utilized to drive the projectile through the barrel and out of the muzzle 20 of the barrel 14.

FIG. 2 shows the barrel 14 in section with a cartridge 21 in the firing chamber 19 of the barrel. The cartridge 21 has a projectile 22 and a casing 23 assembled prior to discharge in a manner well known in the art.

Spaced longitudinally along the barrel toward the muzzle 20 of the barrel are grooves 24 which extend longitudinally of the barrel. FIG. 2*a* shows that the grooves 24 are diametrically opposed. The grooves 24 are of a length greater than the length of the projectile 22.

In the operation of the invention, cartridge 21 is detonated under the impact of the firing pin 16 as previously described. Projectile 22 is separated from the casing 23 and the projectile starts to move to the left in FIG. 2 down the barrel toward the muzzle 20. Movement of the projectile 22 is through the action of the gas generated by the explosion of the powder in the casing 21. As the projectile continues to move down the barrel to the left in FIG. 2, it passes between the grooves 24, as shown in dotted lines in FIG. 2. As it passes between the grooves 24 because the length of the grooves 24 is greater than the length of the projectile 22 in contact with barrel 14, the propelling gas which is under high pressure can bypass around the projectile 22 before the projectile 22 continues down the barrel 14 to the left and seals off the left hand end of the grooves 24. This bypassing of the propelling gas reduces the gas pressure in the barrel 14 behind the projectile 22, and thus reduces the propelling force remaining to drive the projectile 22 out of the muzzle 20 of the barrel 14. Consequently, the muzzle velocity of the projectile 22 is reduced below that which would normally result from the detonation of the cartridge 21.

FIGS. 2 and 2*a* show a pair of diametrically opposed grooves 24. But, it will be apparent to persons skilled in the art that the inventive concept generally involves an ability to bypass a portion of the propelling gas around the projectile as the projectile passes down the barrel toward the muzzle 20. Thus, instead of a pair of grooves 24, a single groove could be used.

As will be apparent to persons skilled in the art from the teaching of the present invention, the longer it takes for the projectile 22 to travel the length of the grooves 24, the more gas pressure will be bypassed around the projectile 22 and thus reduce the muzzle velocity of the projectile 22 accordingly. Experimentation will show, for any particular standard cartridge, how long the grooves or groove 24 must be so as to produce the desired muzzle velocity.

It should also be noted that the grooves 24 function in an entirely different manner than the rifling which is normally present in the barrel of a firearm discharging a single projectile. Rifling in the barrel is for the purpose of causing the projectile to spin about its longitudinal axis. This is achieved by a series of spiral grooves unshown in FIGS. 1–6 but shown in FIGS. 7, 7*a*, 8 and 8*a* starting immediately adjacent the firing chamber and continuing on to the muzzle of the barrel. The rifling is relatively shallow as compared to the grooves 24, and as the projectile 22 enters the barrel upon detonation of the cartridge 23, a portion of the outer surface of the projectile 22 is swaged or wedged into the rifling and as the projectile 22 is forced down the barrel toward the muzzle the spiral nature of the rifling causes the projectile 22 to spin or rotate about its longitudinal axis, and this spin is continued as the projectile leaves the muzzle to improve the accuracy of the firearm because the rotating projectile 22 has a lesser tendency to tumble or follow an erratic flight after it leaves the muzzle 20 of the firearm.

FIG. 3 discloses a modification of the barrel 14 where sets of grooves 24*a* and 24*b* are provided longitudinally spaced in the barrel. Both sets of grooves 24*a* and 24*b* are of a length greater than the length of the projectile 22.

FIG. 4 is a further longitudinal cross-section of the barrel 14, showing a series of circumferentially spaced grooves 24*c*. FIG. 4*a* is a cross-section showing the circumferential arrangement of the grooves 24*c*. If desired, sets of such circumferentially arranged grooves 24*c* could be longitudinally spaced along the barrel, much like the arrangements of the sets 24*a* and 24*b* in FIG. 3.

FIG. 5 discloses the barrel 14 with a pair of grooves 24*d* extending longitudinally of the barrel but at an angle to the longitudinal axis of the barrel 14.

It will be appreciated that it is within the skill of a person experienced in the art of firearms to determine cross-sectional area of the grooves, the number of grooves and the length of the grooves, all of which factors control the amount of gas pressure which is bypassed around the projectile and thus control the muzzle velocity of the projectile.

As to a specific example of the practice of the invention, and with reference to the embodiment of FIGS. 2 and 2*a*, each of the pair of grooves 24 had a width of 0.090 (2.29 mm) inches; 1.27 mm a depth of 0.050 inches; and a length of 1.25 inches (3.175 mm). The ammunition used was 9 mm. Projectile developed for a weapon particularly of the type shown in FIG. 1, and normally produces a projectile muzzle velocity of 1,350 feet per second (394 meters per second). With the modification of the barrel 14 as shown in FIG. 2, and with the above dimensions with regard to the grooves, the muzzle velocity of the projectile, using the same ammunition, dropped to 917 feet per second (279 meters per second).

Obviously, the muzzle velocity could be decreased even further, utilizing the embodiment of FIG. 3 with grooves 24*a* and 24*b* of the same dimension. The variations in muzzle velocity for standard ammunition can thus be varied in any manner to serve any particular purpose.

One practical application of such modification of the barrel of a firearm to control muzzle velocity is where the user of the firearm desires to control the penetration of the projectile into a target, and still use standard ammunition. Many times it is impossible to obtain nonstandard ammunition capable of giving the desired muzzle velocity of the projectile, when in the field of use of the firearm. The present invention solves this problem. Also, different loads for ammunition are limited in number, so that it is not always possible to obtain ammunition which will produce a desired muzzle velocity of the projectile.

With the present invention, the operator of the firearm would merely select the barrel to produce the muzzle velocity of the projectile to suit the desired purpose, and would not have to change ammunition.

For example, security agents might desire a weapon capable of discharging a projectile of a sufficient weight to produce the impact desired in the target, but with a reduced muzzle velocity so that the target is not completely penetrated or that in the event that the projectile misses the target, it would not cause excessive damage in areas beyond the target. That is, a security agent aboard an aircraft which is pressurized and at high altitude, is trying to control a terrorist activity. The agent would want to insure that the projectile would not penentrate the target and impact and probably pass through the side of the aircraft, causing depressurization of the aircraft. Likewise, the security agent might desire the muzzle velocity to be so low that if the target were missed, the muzzle velocity of the projectile would be inadequate to enable it to penetrate through the side of the aircraft or penetrate any structure of the aircraft which would cause serious damage to the aircraft.

Another example of utilization of the present invention would be riot control by security force. Initially, riot control requires the use of less than deadly force. But if the security forces are exposed to deadly force against them, they must resort to deadly force to protect themselves. Normally, this would require the security forces to carry two weapons, one to produce a nondeadly force on a target, and a second to produce a deadly force. With the present invention, the security force can carry a single weapon, with standard ammunition therefore and interchangeable barrels. One barrel having the grooves therein to reduce the muzzle velocity of the projectile fired to a non-deadly force, and a non-modified barrel capable of producing a deadly force.

A further example of utilization of the invention is exemplified in FIG. 6. FIG. 6 discloses the barrel 14 having threads 25 around the exterior of the end of the barrel. Threaded onto the threads 25 is a sound suppressor 26. The sound suppressor 26 is of the conventional type comprising a series of baffles 27 longitudinally spaced in a hollow cylinder 28. Each of the baffles 27 has a central opening 29 in alignment with the bore of the barrel 14. As is well known in the art, a sound suppressor operates to permit the projectile to pass out of the muzzle of the barrel, sequentially pass through all of the baffles via the central opening 29 in each of the baffles, and pass out through the opposite end of said suppressor 26. The opposite end of the suppressor 26 has an end plug (not shown) not unlike end plug 30 which mounts the suppressor 26 on the barrel 14. Normally, a percursor wave proceeds the projectile and enters the atmosphere at high velocity, and expends at a rate causing a loud noise. A sound suppressor enables the projectile to enter the atmosphere before the precursor wave does, due to the fact that the precursor wave is slowed down in its movement by successive expansions into the successive volumes 31 between adjacent baffles 27. The present invention has utility where even with a sound suppressor 26 in operation, because the projectile could leave the sound suppressor at a velocity greater than 1,120 feet per second (340 meters per second) at sea level and thus is travelling at supersonic speed, the result would be creation of a shock wave with the attendant noise. Thus, use of standard ammunition producing a muzzle velocity over 1,120 feet per second defeats the purpose of the sound suppressor 26. By utilization of the invention of the present application, it is possible to slow down the velocity of the projectile so that the muzzle velocity of the projectile as it enters the sound suppressor 26 is reduced to below supersonic. This eliminates the creation of a shock wave which normally would produce noise.

In all of the previous embodiments of the invention, the bypass grooves have always been shorter in length than the length of the barrel. This means that the depth of the bypass groove and its length are factors which control the amount of gas which is bypassed around the projectile during the time that the projectile passes the length of the grooves. Such a system is workable and highly accurate in controlling muzzle velocity. It is also relatively expensive, because of the machining steps which must be utilized to place grooves in the interior of the barrel, which are of a length less than the length of the barrel. The embodiments of FIGS. 7, 7*a*, 8 and 8*a* utilize the same inventive concept which has been previously described with regard to the embodiments of FIGS. 1 to 6, but reduces the expense of the machining operations by providing at least one groove which extends from one end of the barrel to the other.

More specifically, in the embodiment of FIG. 7, a single longitudinal groove 32 is provided in the barrel 14 extending the entire length of the barrel from the firing chamber to the muzzle 20. As shown in FIG. 7*a*, which is a muzzle end view of the barrel of FIG. 7, the groove 32 is deeper than the normal rifling 33 in the barrel.

FIG. 8 discloses a further modification following the principle of FIG. 7, except that a plurality of grooves 34 are provided and such grooves are superimposed upon and coextensive with the normal rifling which would exist in a rifled gun barrel. In other words, FIG. 8 discloses an embodiment whereby the depth of the normal rifling which is normally between 0.002 and 0.008 has been increased in depth so as to provide a plurality of bypass grooves, which permit the gas pressure generated by detonation of the cartridge, to pass around the projectile during the projectile's movement down the barrel. The rifling provides lands and grooves which rotate the projectile, for example, approximately one turn every 16 inches. Even though the grooves have been deepened in the embodiment of FIG. 8 to provide the bypass areas around the projectile, the lands still exist so that they act upon the projectile to give it a turning motion as it proceeds down the barrel and thus still provides the normal function of rifling so that the projectile is rotating as it leaves the muzzle of the gun to improve the accuracy of the projectile.

In both the embodiments of FIGS. 7 and 8, it has been found preferable that the bypass area provided by the single groove or the plurality of grooves has a certain function of the cross sectional area of the barrel. That is, the groove or grooves should preferably be 3 to 50 times normal rifling groove depth. The 3 times normal rifling depth is adequate for hand guns but for rifles it should be deeper, and for cannon (i.e. 20 millimeter) deeper still because the gas generating charge is so much larger.

Various applications of the invention will be apparent to persons skilled in the art. The invention shall be defined by the scope of the appended claims.

I claim:

1. A rifled barrel for a firearm comprising:

an elongated tube with a front end, a rear end and a firing chamber adjacent the rear end of the tube;

a plurality of rifling grooves of a depth corresponding to the diameter of a bullet to be fired from said barrel extending from the front of said firing chamber to the front end of the tube; and at least one gas pressure relief groove in said tube;

said groove extending from the front of said firing chamber to the front end of the tube;

said groove having a depth greater than the depth of said rifling grooves;

whereby some of the gas pressure generated in the firing chamber upon firing of a cartridge including a projectile therein will continuously bypass around the cartridge projectile as the projectile moves down the barrel and reduce the muzzle velocity of the projectile.

2. A rifled barrel as in claim 1, wherein said gas pressure relief groove is separate from the rifling grooves in said barrel.

3. A rifled barrel as in claim 1, including a plurality of said gas pressure relief grooves, said gas pressure relief grooves being superimposed and coextensive with the rifling grooves in said barrel.

4. A rifled barrel as in claim 1, wherein said gas pressure relief groove provides a by-pass area which is 3 to 50 times the depth of the rifling grooves in said barrel.

5. A rifled barrel as in claim 3, wherein said plurality of gas pressure relief grooves are 3 to 50 times the depth of the rifling grooves in said barrel.

* * * * *